US005799349A

United States Patent [19]

Petersen

[11] Patent Number: 5,799,349

[45] Date of Patent: Sep. 1, 1998

[54] SURGICAL KNEE HOLDER

[76] Inventor: Thomas D. Petersen, 9680 Alto Dr., La Mesa, Calif. 91941

[21] Appl. No.: 966,231

[22] Filed: Nov. 7, 1997

[51] Int. Cl.[6] ..... A61G 13/12; A61G 13/10

[52] U.S. Cl. ..... 5/624; 5/651

[58] Field of Search ..... 5/624, 648, 621, 5/622, 623, 651

[56] References Cited

U.S. PATENT DOCUMENTS

| | | | |
|---|---|---|---|
| 1,852,586 | 4/1932 | McKnight | 269/90 |
| 2,581,110 | 1/1952 | Kenworthy | 5/648 |
| 3,880,417 | 4/1975 | Burris et al. | 5/624 |
| 4,136,858 | 1/1979 | Petersen | 5/648 |

OTHER PUBLICATIONS

Brochure Titled "The Alvarado Knee Support (1981)". Zimmer Blueprint No. 00–1320–010–00 dated Aug. 18, 1980.

*Primary Examiner*—Alexander Grosz

*Attorney, Agent, or Firm*—H. Jay Spiegel

[57] ABSTRACT

A knee holder includes a base plate having two parallel rows of slots designed to hold the ends of a cylinder to which is attached a foot cradle. Each slot has the appearance of an inverted symmetric "T" allowing reversability of the orientation of the foot cradle. The base plate has an "L"-shaped arm extending along its upper surface and then having a right angle bend to extend downwardly. The arm is sized to be received within an opening of a clamping bracket attached to a rail of a surgical table or other horizontal support surface on which the base plate has been placed, with the clamping bracket including structure allowing locking of the arm in fixed position to fix the position of the knee holder. The base plate is sized to allow two knee holders to be mounted on a surgical table side by side to facilitate performance of a bilateral procedure. The knee holder includes a foot cradle having a reinforced foot receiving member and a cylindrical bracket having reduced diameter posts removably attachable to the cylindrical bracket and made of a material such as stainless steel. The posts may be received in opposed slots in any one of three orientations for each of two opposed orientations of the foot receiving member.

20 Claims, 7 Drawing Sheets

SURGICAL KNEE HOLDER

BACKGROUND OF THE INVENTION

The present invention relates to an improved surgical knee holder. The present invention comprises improvements over Applicant's prior U.S. Pat. No. 4,136,858 issued Jan. 30, 1979 and titled "SURGICAL KNEE HOLDER".

The invention disclosed in Applicant's prior patent is seen with reference to FIG. 4 herein and is generally designated by the reference numeral 10 including a base plate 12 having two parallel rows 16 of slotted hooks with the slots being designated by the reference numeral 20 and with the hooks being designated by the reference numeral 18. As seen in FIG. 4, the slots are "L"-shaped. The foot cradle 22 includes a cylindrical bracket member 28 having opposed slot engaging pins 30 of which one is seen in FIG. 4. As seen in FIG. 4, the pins 30 may be received within slots 20 by reciprocating the bracket member 28 downwardly and then forward into the locked position shown in FIG. 1.

As should be understood from FIG. 4, in Applicant's prior patent, the knee holder has limited versatility. Thus, as seen in FIG. 4, one may not reverse the orientation of the foot cradle 22 with respect to the base 12 since the slots 20 only allow locking of the pins 30 in the direction of orientation shown in FIG. 4. Accordingly, several years ago, ZIMMER, INC., the exclusive licensee of Applicant's prior patent, modified the slots 20 so that they were "T"-shaped, allowing the pins 30 to be locked in either direction of orientation of the foot cradle 22. While this modification improved the versatility of the knee holder, additional limitations still remained. Thus, Applicant's prior patent disclosed no means for firmly fixating the base 12 on a surgical table. The sole disclosed means consisted of a buttress plate designed to be engaged by one side of the base 12 but with no fixed interconnection therebetween. Nor did Applicant's prior patent contemplate the use of two knee holders side by side or the need to reinforce and strengthen various aspects of the foot receiving member thereof.

Thus, a need has developed for an attachment means for the base of a surgical knee holder allowing firm fixation on the surgical table while retaining a degree of versatility allowing adjustments in orientation to accommodate to both feet of the patient as well as to the particular orientation of the patient on the table. Additionally, a need has developed for such a device with a strengthened foot receiving member and with structure allowing simultaneous use of two such devices. It is with these needs in mind that the present invention was developed.

SUMMARY OF THE INVENTION

The present invention relates to an improved surgical knee holder. The present invention includes the following interrelated objects, aspects and features:

(1) In a first aspect, the present invention includes a base plate having two parallel rows of slots, each of which resembles an inverted "T". The base plate includes a top surface on which the two parallel rows of slots are mounted. The base plate is dimensioned to permit two knee holders to be used side by side.

(2) Also mounted on the top surface of the base plate is an "L"-shaped attachment arm having a short leg affixed to the top surface of the base plate and having a long leg perpendicular thereto and perpendicular to the top surface of the base plate extending a desired distance below the base plate for attachment to the surgical table.

(3) A foot cradle has a foot receiving member and, connected beneath the heel thereof, a horizontally disposed cylinder having reduced diameter end posts sized to be receivable within the inverted "T"-shaped slots. The end posts are made of strong material such as 17-4 heat hardened stainless steel and may be screwed into threaded recesses in the cylinder where the cylinder is made of a diverse material. The underside of the foot receiving member has a reinforcing plate welded thereto.

(4) The foot cradle end posts may be inserted within two opposed inverted "T"-shaped slots in any one of three orientations for each of two opposed directions of orientation of the foot cradle, including (1) an orientation where one post is located at the front of one slot with respect to the patient's buttocks while the other post is located at the front of an opposed slot forwardly staggered with respect to the first-mentioned slot, (2) the reverse of orientation (1), and (3) an orientation where both posts are disposed at the front, with respect to the buttocks of the patient, of respective laterally aligned slots. The "L"-shaped attachment arm allows firmly fixating the base plate on a surgical table or other horizontal surface. Additionally, the "L"-shaped attachment arm allows reversal of the position of the base plate to accommodate to the left or right leg of the patient and only depends upon placement of a clamping member on the surgical table, bed or other horizontal support surface.

Accordingly, it is a first object of the present invention to provide an improved surgical knee holder.

It is a further object of the present invention to provide such a knee holder including a base plate having two parallel rows of inverted "T"-shaped slots and sized so that two base plates may be attached to a surgical table side by side.

It is a yet further object of the present invention to provide such a knee holder wherein the base plate thereof includes an "L"-shaped attachment arm allowing firm fixation of the base plate on a horizontal support surface such as a surgical table.

It is a yet further object of the present invention to provide such a base plate with the ability to be reversed as to orientation to accommodate to different legs of a patient.

It is a still further object of the present invention to provide such a device with a reinforced foot cradle.

It is a yet further object of the present invention to provide such a device permitting end posts thereof to be received in opposed slots in any one of three orientations for each opposed foot cradle orientation.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 3:
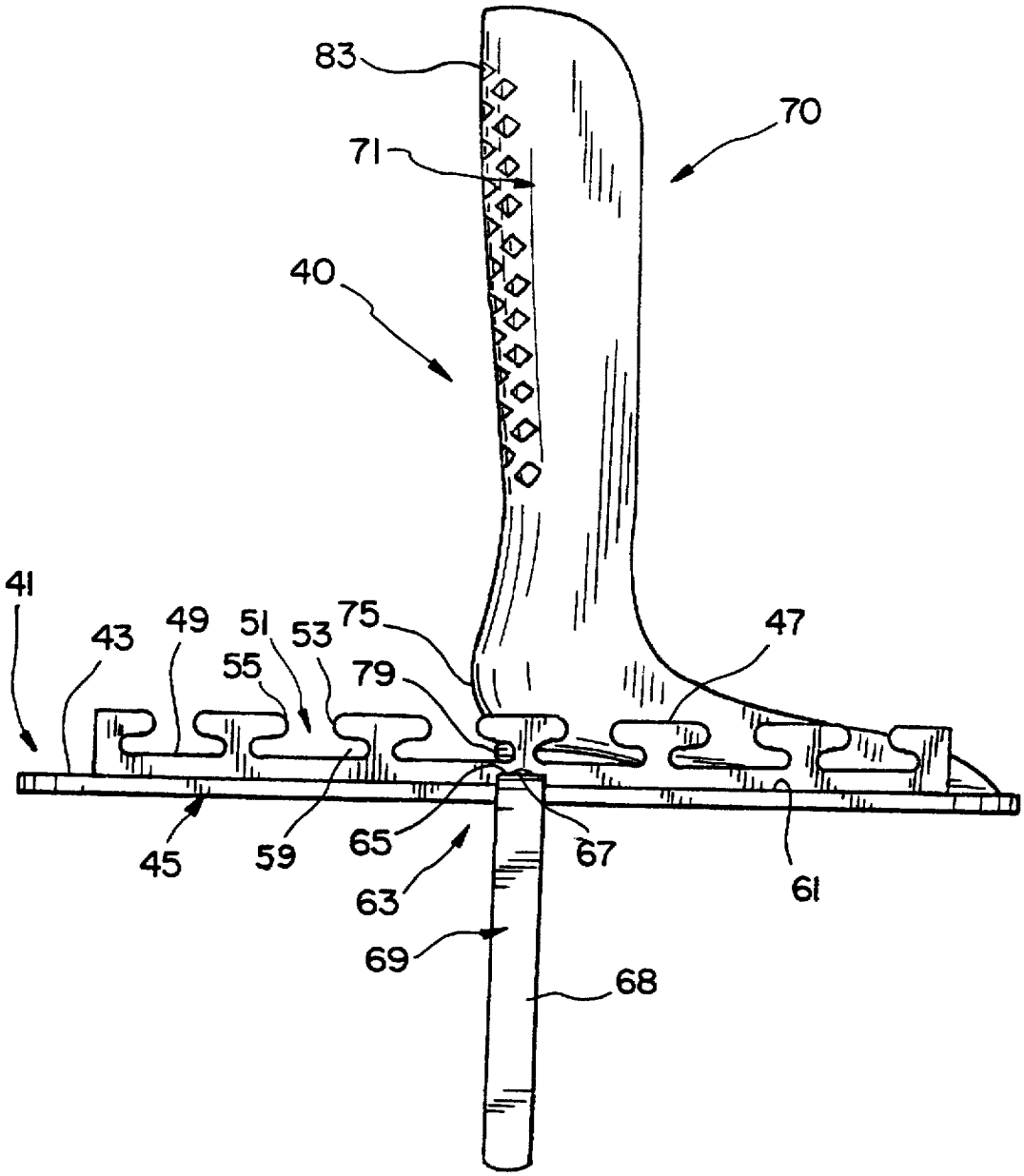
FIG. 3 shows a side view of the invention with the parts oriented as shown in FIG. 1.
Figure 4:
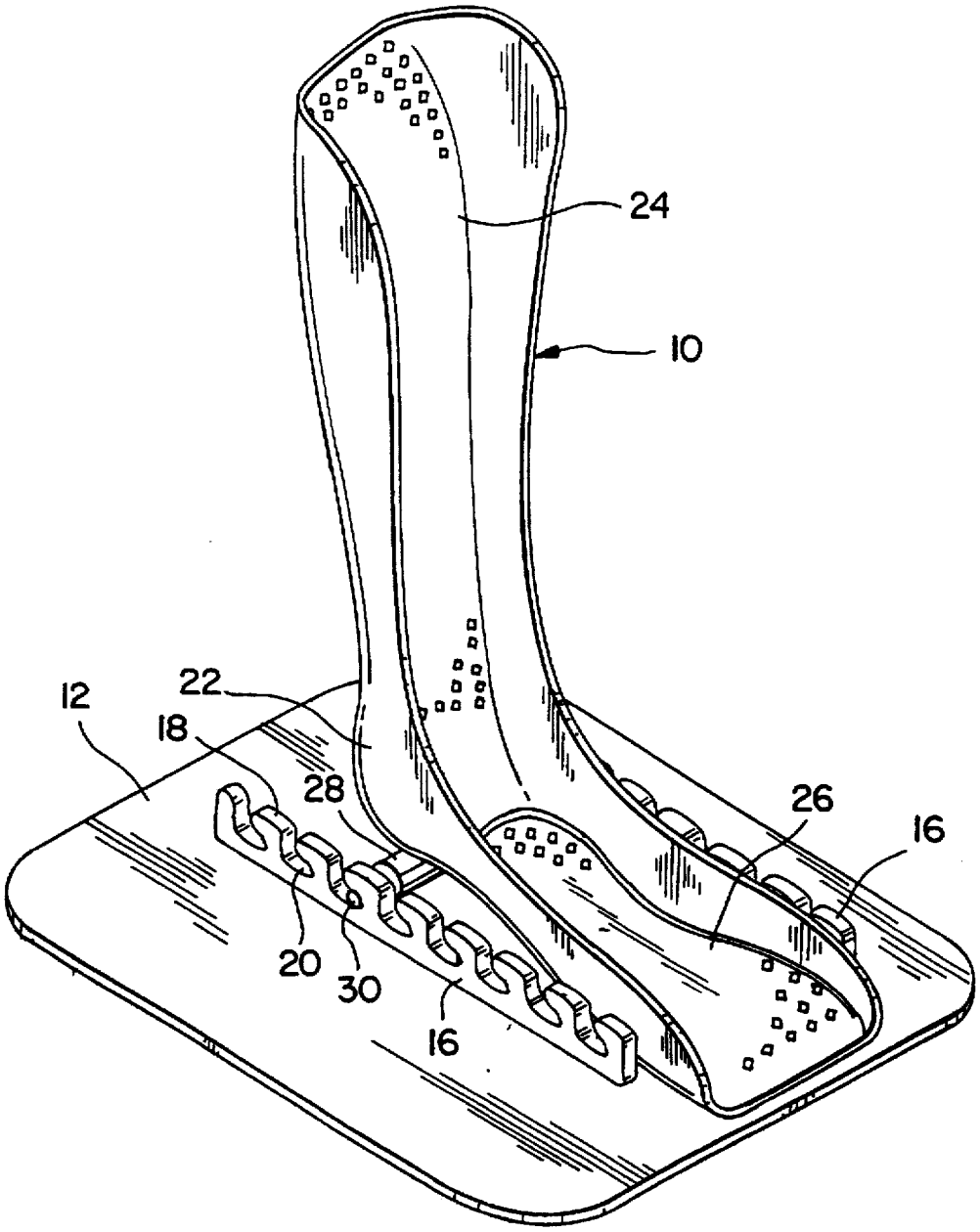
FIG. 4 PRIOR ART
FIG. 4 shows a front-side perspective view of Applicant's prior invention corresponding to FIG. 1 of Applicant's prior U.S. Pat. No. 4,136,858.

The present invention is generally designated by the reference numeral 40 and is seen to include a base plate 41 and a foot cradle 70. The base plate includes a flat plate 43 having two parallel rows 45 and 47 of slots 49, each of which resembles an inverted symmetric "T". As seen in FIG. 3, in particular, a typical slot includes an opening 51 defined by two opposed arcuate surfaces 53 and 55, with the opening 51 opening into opposed slot portions 57 and 59.

With reference back to FIG. 1, the plate 43 has a top surface 61 on which the rows of slots 45 and 47 are suitably mounted. Additionally, an "L"-shaped attachment arm 63 is also mounted on the surface 61 and includes a short leg 65 suitably fastened to the plate 43 through the use of fasteners 67 and a longer leg 69 that extends downwardly perpendicular to the surface 61 and for a considerable distance below the surface 61.

Figure 1:
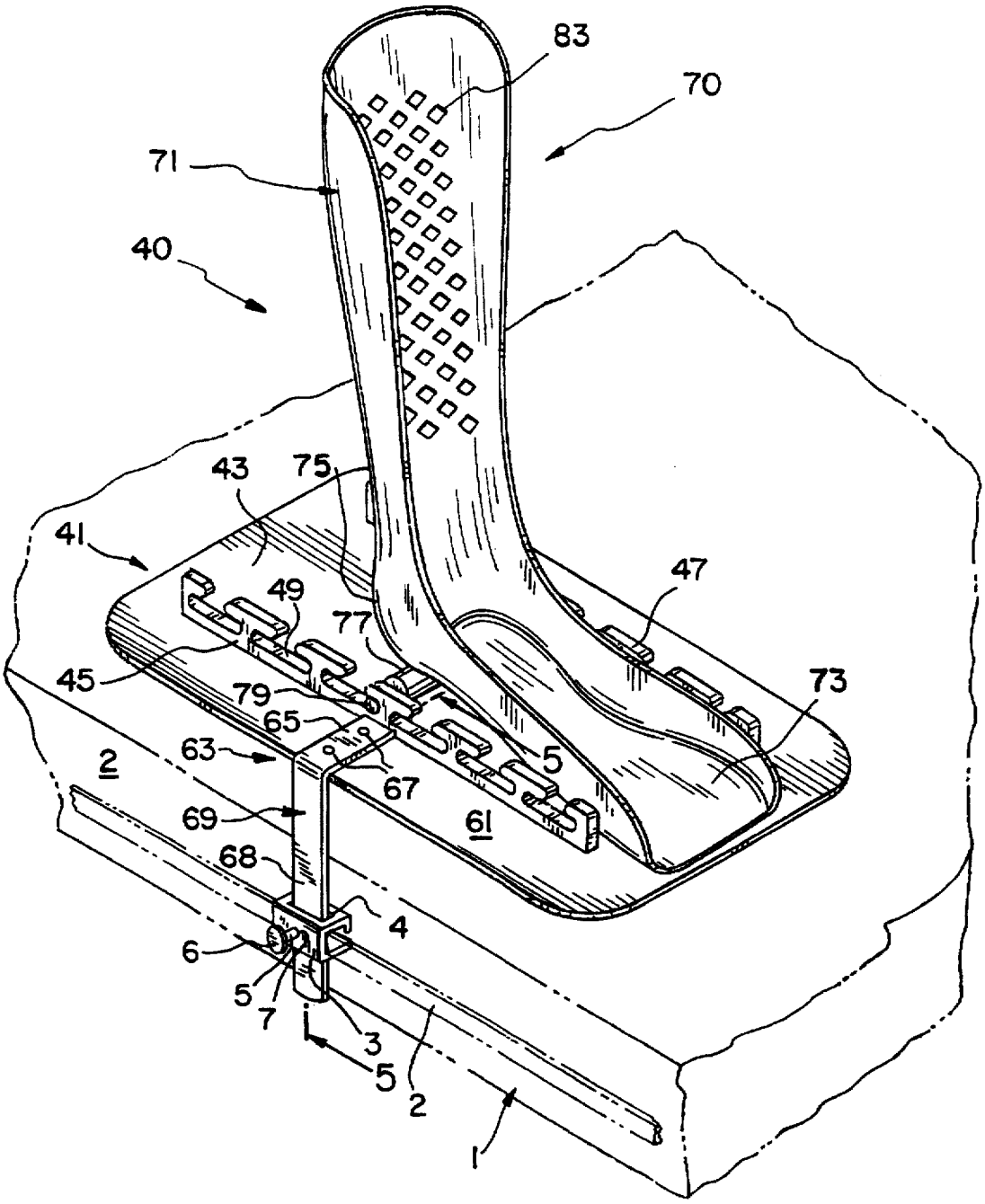
FIG. 1 shows a front-side perspective view of the present invention.
Figure 5:
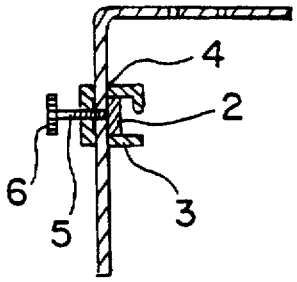
FIG. 5 shows a cross-sectional view along the line 5—5 of FIG. 1.
Figure 7:
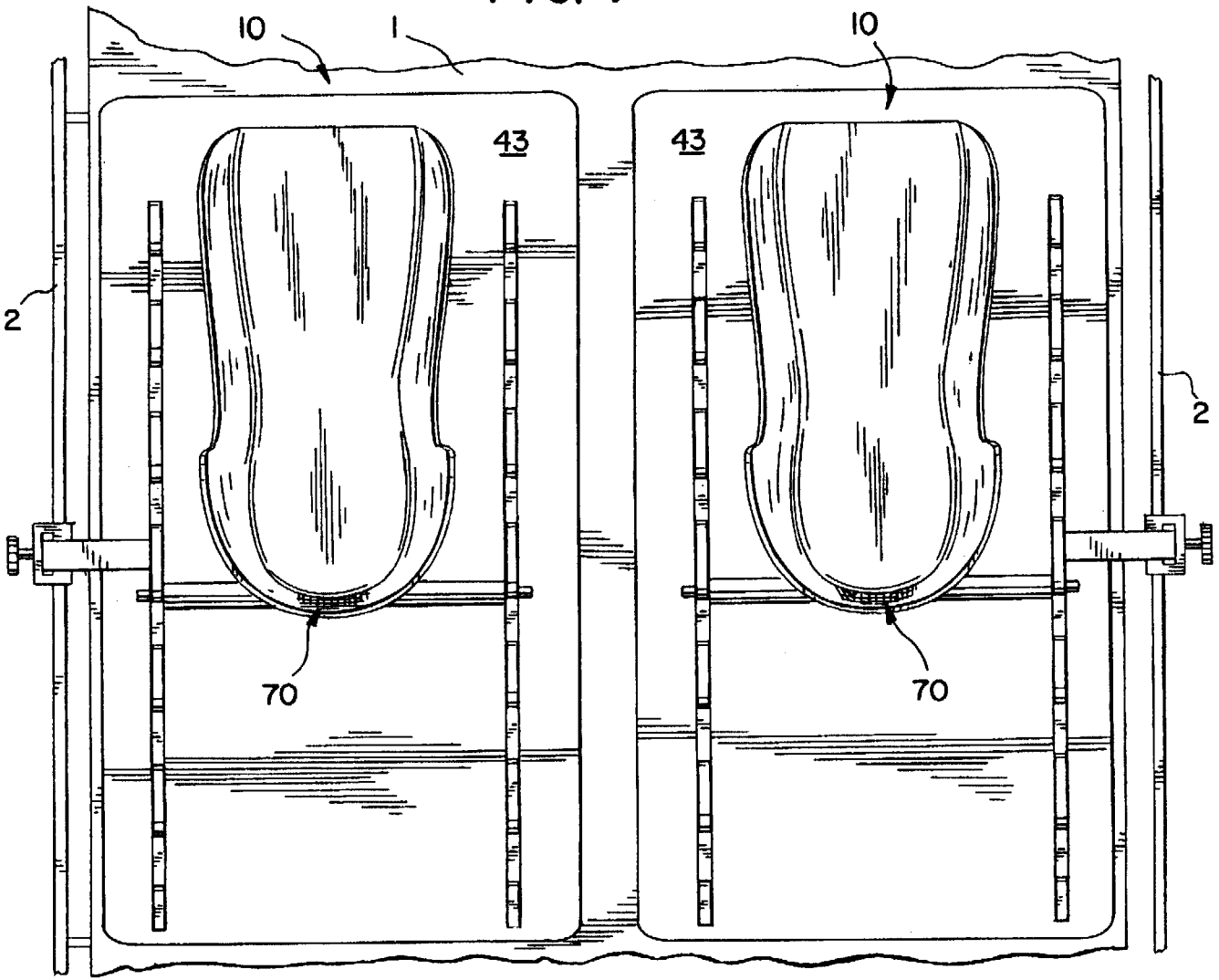
FIG. 7 shows a top view of a surgical table with two knee holders clamped thereon side by side.

FIG. 1 also shows a surgical table 1 (or other horizontal support surface) in phantom and which includes a rail 2 on which is releasably mounted (in a manner well known) a clamping bracket 3 (FIGS. 1 and 5) defining an opening 4 (along with the rail 2) that is sized to receive the rectangular cross-section leg 69 of the "L"-shaped attachment arm 63. A screw member 5 (FIG. 5) has a knob 6 attached thereto and rotation of the knob 6 allows rotation and reciprocation of the screw 5 through an opening 7 formed in the clamping bracket 3 so that the end of the screw 5 can bear against the surface 68 of the leg 69 to frictionally retain the leg 69 and thereby the attachment arm 63 and the attached plate 43 in a firmly fixated position. As seen in FIG. 7, the plate 43 is dimensioned to permit attachment of two plates 43 side by side to a table 1 having opposed rails 2 to permit a bilateral procedure (both knees on one patient) to be conducted.

Figure 2:
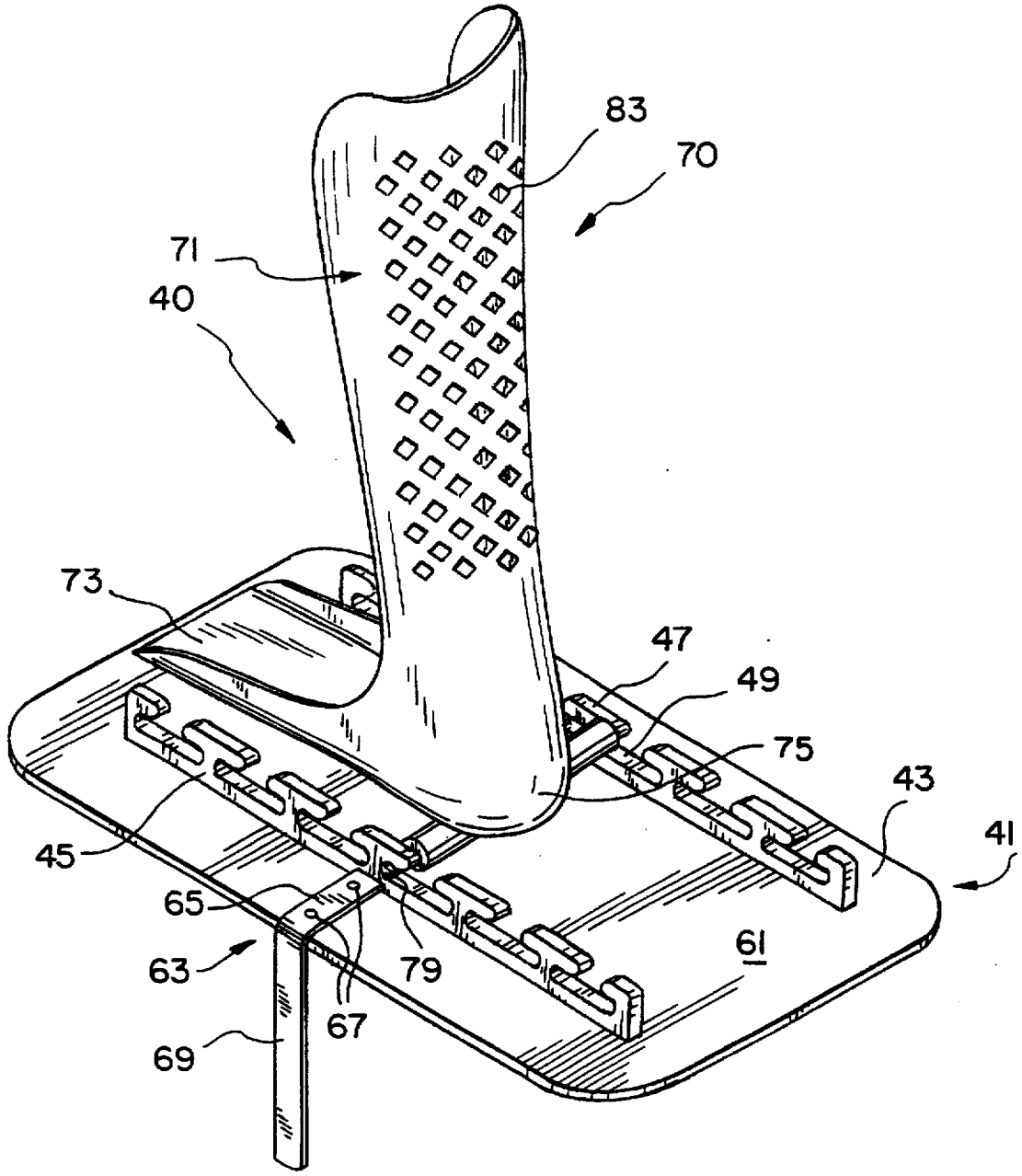
FIG. 2 shows a perspective view similar to that of FIG. 1 but with the foot bracket of the present invention reversed as to orientation with respect to the base plate.
Figure 6:
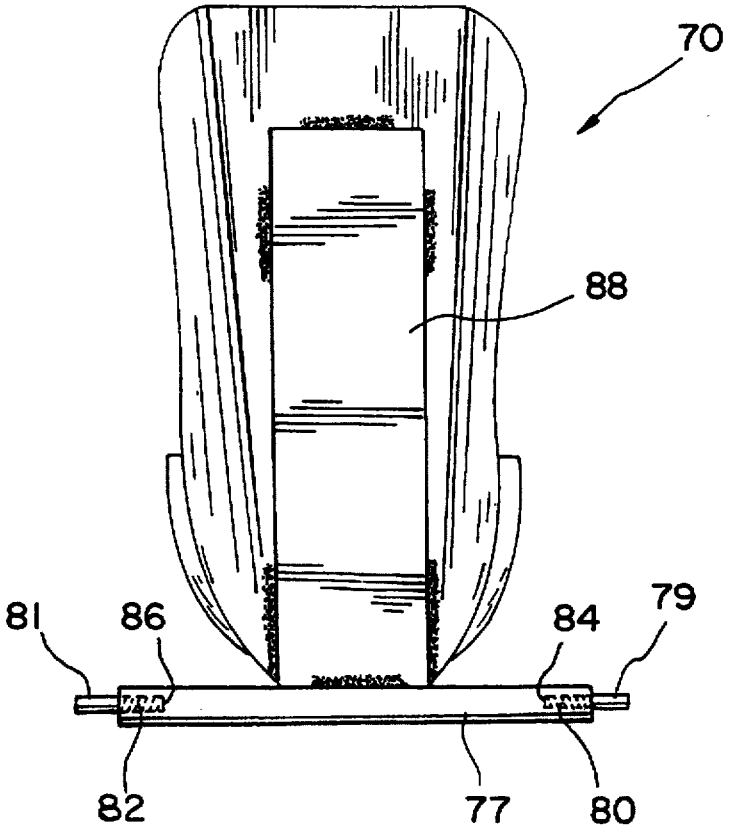
FIG. 6 shows a bottom view of the inventive foot bracket.

With reference to FIGS. 1, 2, 3 and 6, the foot cradle 70 includes a generally vertical portion 71 sized to receive the rear of the lower leg of the patient, whether the left or right leg, and a foot support 73. Beneath the heel 75 of the foot cradle 70, a horizontally disposed cylindrical bracket member 77 is provided that includes reduced diameter end posts 79 and 81 (FIG. 2). The cylindrical bracket member is affixed beneath the heel 75 of the foot cradle 70 by any suitable means such as, for example, welding. As seen in FIG. 6, the posts 79 and 81 may be made as separable structures having threaded ends 80 and 82, respectively, threadably received in threaded recesses 84 and 86, respectively, in the member 77. A reinforcing plate 88 is securely welded to the underside of the foot support 73 and to the member 77. The plate 88 strengthens the foot support 73 and prevents bending and deformation thereof. In one example, the foot cradle 70, member 77 and plate 88 may be made of aluminum while the posts 79 and 81 may be made of 17-4 heat hardened stainless steel. Such posts reduce galling of the slots 49 of the rails 45 and 47, which rails are preferably made of aluminum.

With reference to FIGS. 1 and 2, it is seen that the structure of the present invention allows the foot cradle 70 to be installed on the base plate 41 in either one of two opposed orientations. As seen in FIGS. 1 and 3, a first orientation includes, for example, placement of the posts 79 and 81 of the cylindrical bracket member 77 within two opposed recesses 49 with the foot cradle facing a first direction.

With reference to FIG. 2, the orientation of the foot cradle 70 is reversed.

Figure 8A:
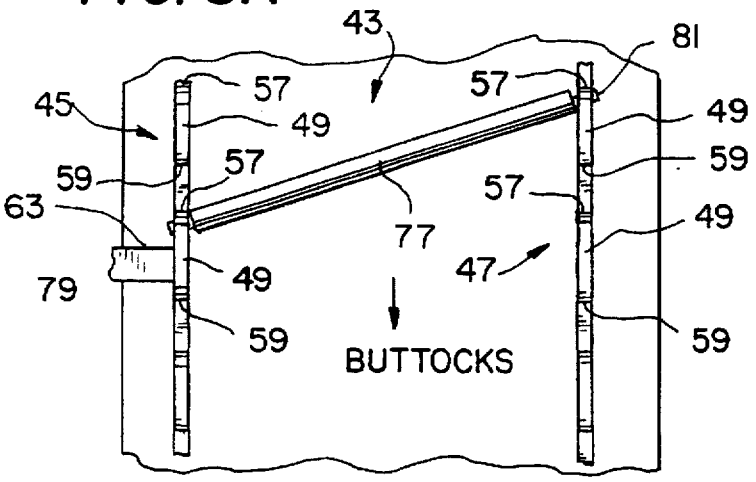
FIGS. 8a–8c show three possible orientations for the end posts within opposed inverted "T"-shaped slots.
Figure 8B:
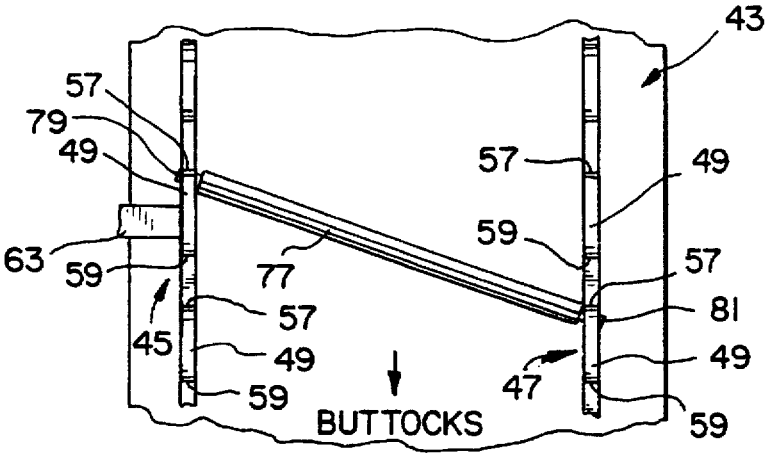
Figure 8C:
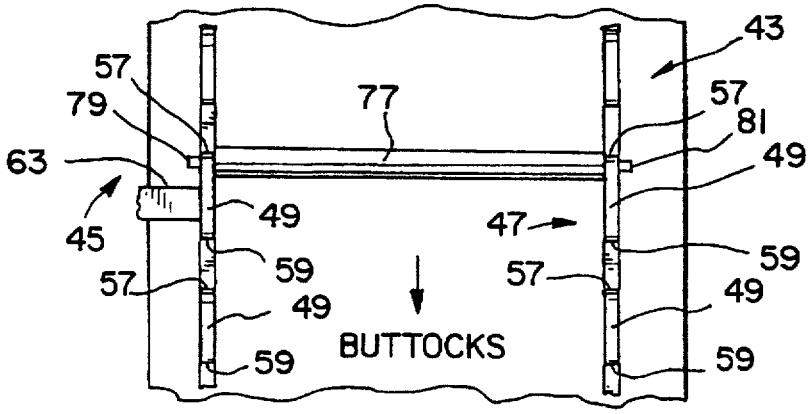

With reference to FIGS. 8a–8c, in either orientation of the foot cradle 70, the end posts of the cylindrical bracket member 77 may be placed within opposed inverted "T"-shaped slots 49 in any one of three orientations. With reference to FIG. 8c, the respective end posts 79, 81 of the cylindrical bracket member 77 may engage the respective ends 57 of opposed slots 49. Alternatively, with reference to FIG. 8a, the end post 79 of the cylindrical bracket member 77 may engage the end 57 of one slot 49 while the end post 81 of the cylindrical bracket member 77 engages the end 59 of the other slot 49, which other slot is laterally staggered in the forward direction further from the patient's buttocks.

Alternatively, with reference to FIG. 8b, one end post 79 of the cylindrical bracket member 77 may engage the end 57 of a slot 49 while the end post 81 of the cylindrical bracket member 77 engages the end 59 of the other slot 49, which other slot is laterally staggered in the rearward direction closer toward the patient's buttocks.

With particular reference to FIGS. 8a and 7, with particular reference to the location of the attachment arm 63, it should be apparent that the side of the base plate 43 adjacent the attachment arm 63 represents the outside of the respective leg of the user retained in the foot cradle 70 thereof. Thus, with particular reference to FIG. 8a, where the cylindrical bracket member 77 is oriented as shown in FIG. 8c with the end post 79 at the front 57 of the left-hand slot 49 while the end post 81 is at the end 57 of the forwardly staggered right-hand slot 49, the patient's leg is in a position described as external rotation of the foot that results in locking of the ligaments in the knee of that leg to prevent the leg from falling outward. This particular orientation is an enhanced orientation for the performance of knee surgery.

As should also be understood, by appropriate placement of clamping members 3 at different locations on side walls of the horizontal surface on which the base plate 41 is to be supported, the position of the base plate 41 may be reversed to accommodate either leg of the patient. Thus, with reference to FIG. 1, envisioning that the right leg of the patient could be supported within the foot bracket 70 in the orientation shown, if it is desired to support the left leg, instead, provided a clamping member 3 is located on the opposite side of the table from the side 2 shown in FIG. 1, the knob 6 could be rotated to release pressure on the leg 69 of the "L"-shaped attachment arm 63, whereupon the base plate 41 could be lifted from the table 1 and rotated 180° while maintaining the surface 43 horizontal with the leg 69 then inserted into a clamping bracket 3 mounted on a rail 2 on the other side of the table. In such orientation, the foot cradle 70 would be facing the opposite direction from the direction it faces in the view of FIG. 1. Thus, the foot cradle 70 could be removed from the two opposed slots 49, and could be reversed 180° in orientation so that it then would face the same direction as it faces in the view of FIG. 1 to allow accommodation to the left leg of the patient. Such versatility is unknown in the prior art and provides a considerable advance thereover. Returning to FIGS. 8a–8c and noting the location of the attachment arm 63 and the position of the buttocks of the patient, these figures show positions of the member 77 (and impliedly of the foot cradle 70) for the patient's left leg. Referring to FIGS. 7 and 8a–8c, it is easy to understand that the base plate 43 can be reversed so that the attachment arm 63 is on the right hand side thereof to be attached on the right hand side of the table 1 to accomodate the patient's right leg with the positions of the member 77 (and of the attached foot cradle 70) shown in FIGS. 8a–8c available in that reversed orientation of the base plate 43. Reference is, again, made to FIG. 7 which shows two knee holders 40 including base plates 41 dimensioned to facilitate side by side placement on a surgical table 1 for conducting of a bilateral procedure.

In the preferred embodiment of the present invention, the plate 43, rows of slots 45 and 47 and the foot cradle 70 may be made of any suitable materials with strong metallic materials being preferred given the ability of the human leg to exert enormous pressure in the slots 49. In the preferred embodiment, the rows 45 and 47 of slots are suitably welded to the plate 43.

As such, an invention has been disclosed in terms of a preferred embodiment thereof which fulfills each and every one of the objects of the invention as set forth above and provides a new and improved surgical knee holder of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. An improved surgical knee holder, comprising:

a) a flat base plate having a pair of parallel rows of slots disposed on a top surface thereof;

b) a base plate attachment arm affixed to said base plate and having a leg extending away therefrom, said leg being adapted to be releasably affixed to a support for said base plate;

c) a foot cradle having a foot receiving portion and an elongated member attached under said foot receiving portion and having opposed end posts adapted to be received in respective opposed ones of said slots;

d) said foot cradle including an elongated reinforcing plate having a periphery and being attached under said foot receiving portion and attached to said elongated member, said reinforcing plate extending over a majority of a length of said foot receiving portion and being secured about said periphery to reinforce and strengthen said foot receiving portion.

2. The knee holder of claim 1, wherein each of said slots resembles an inverted "T", said foot cradle posts being receivable in respective opposed ones of said slots in either one of two opposed orientations of said foot cradle, said posts being receivable within opposed ones of said slots in any one of four orientations of said elongated member for each of said orientations of said foot cradle.

3. The knee holder of claim 2, wherein said opposed ones of said slots are laterally staggered.

4. The knee holder of claim 1, wherein said leg extends perpendicularly below said top surface.

5. The knee holder of claim 4, wherein said base plate attachment arm includes a further leg fastened to said top surface and perpendicular to said leg.

6. The knee holder of claim 1, wherein said leg has a rectangular cross-section.

7. The knee holder of claim 1, wherein each of said posts comprises a stainless steel end post member removably attachable to said elongated member.

8. The knee holder of claim 7, wherein said elongated member is made of aluminum.

9. In combination, a support having a horizontal surface and a clamping member carried on a rail attached to said support, and a surgical knee holder mounted on said support and comprising:

a) a flat base plate having a pair of parallel rows of slots disposed on a top surface thereof;

b) a base plate attachment arm affixed to said base plate and having a leg extending away therefrom, said leg being receivable in said clamping member;

c) a foot cradle having a foot receiving portion and an elongated member attached under said foot receiving portion and having opposed ends adapted to be received in respective opposed ones of said slots;

d) said foot cradle including an elongated reinforcing plate having a periphery and being attached under said foot receiving portion and attached to said elongated member, said reinforcing plate extending over a majority of a length of said foot receiving portion and being secured about said periphery to reinforce and strengthen said foot receiving portion.

10. The combination of claim 9, wherein said clamping member includes a screw having an end engageable with said leg to clamp said base plate to said support.

11. The combination of claim 10, wherein said screw has another end with a gripping knob thereon.

12. The combination of claim 9, wherein each of said slots resembles an inverted "T", said foot cradle elongated member opposed ends being receivable in respective opposed ones of said slots in any one of three orientations for each of two opposed orientations of said foot receiving portion.

13. The knee holder of claim 12, wherein said opposed ones of said slots are laterally staggered.

14. The combination of claim 9, wherein said leg extends perpendicularly below said top surface.

15. The combination of claim 14, wherein said base plate attachment arm includes a further leg fastened to said top surface and perpendicular to said leg.

16. The combination of claim 9, wherein said leg has a rectangular cross-section.

17. The combination of claim 9, wherein said support has two opposed rails, said combination including two knee holders mounted side by side on said support, each knee holder affixed to one of said rails.

18. The combination of claim 17, wherein said support comprises a surgical table.

19. The combination of claim 9, wherein said opposed ends of said elongated member comprise reduced diameter posts removably received on said elongated member.

20. The combination of claim 19, wherein said elongated member is made of aluminum and said posts are made of stainless steel.

* * * * *